US005678821A

United States Patent [19]

Hedman

[11] Patent Number: 5,678,821

[45] Date of Patent: Oct. 21, 1997

[54] METHOD OF PLAYING A COMBINATION POKER-LIKE AND BLACKJACK-LIKE WAGERING CARD GAME

[76] Inventor: Michael Hedman, 7603 Grandview Rd., Sacramento, Calif. 95829

[21] Appl. No.: 668,206

[22] Filed: Jun. 19, 1996

[51] Int. Cl.[6] ..... A63F 1/00

[52] U.S. Cl. ..... 273/292; 273/274

[58] Field of Search ..... 273/292, 309, 273/274; 463/13, 12

[56] References Cited

U.S. PATENT DOCUMENTS

| | | | |
|---|---|---|---|
| 4,836,553 | 6/1989 | Suttle et al. | 273/292 |
| 4,861,041 | 8/1989 | Jones et al. | 273/292 |
| 5,265,882 | 11/1993 | Malek | 273/292 |
| 5,288,082 | 2/1994 | Marquez | 273/292 |
| 5,322,295 | 6/1994 | Cabot et al. | 273/292 |
| 5,328,189 | 7/1994 | Malek | 273/292 |
| 5,377,993 | 1/1995 | Josephs | 273/292 |
| 5,395,120 | 3/1995 | Malek | 273/292 |
| 5,417,430 | 5/1995 | Breeding | 273/292 |
| 5,486,005 | 1/1996 | Neal | 273/292 |

OTHER PUBLICATIONS

Editor's Note, WIN Magazine, pp. 39–40 and 70, Apr. 1992.

Advertising brochure from Commerce Casino, Commerce, CA, Wisted's California Blackjack, 1992.

Advertising brochure from Gaming Concepts, Inc., Long Beach, CA, Over/Under 13™ Blackjack, 1988.

Royal Calkins, Blackjack introduced at Table Mountain, The Fresno Bee, Tuesday, Nov. 10, 1992.

*Primary Examiner*—Benjamin H. Layno

*Attorney, Agent, or Firm*—James M. Ritchey

[57] ABSTRACT

A method and for playing a card game between a house and one or more players in which each player wagers three bets on the five card hand they will receive from the house. The house randomizes the cards and distributes the randomized cards into seven hands. The through of dice establishes which of the hands goes to the house and each player in the card game. Each player arranges their five cards into a high blackjack hand and a low blackjack hand, as does the house. Additionally, each hand is used to create a poker hand. A poker hand is created by combining the randomized cards of the high blackjack hand and the low blackjack hand. By comparing each player's hand with the house's hand winning poker hands, winning high blackjack hands, and winning low blackjack hands are established. Winnings are allocated from each of the bets based on the comparison. An optional progressive jackpot bet may be included.

12 Claims, 1 Drawing Sheet

METHOD OF PLAYING A COMBINATION POKER-LIKE AND BLACKJACK-LIKE WAGERING CARD GAME

BACKGROUND OF THE INVENTION

1. Field of the Invention

A card game and apparatus are disclosed that have for each player a plurality of different hands and associated wagering or betting plans and strategies. More particularly, related is a card game and table apparatus that utilize a standard 52 card deck and incorporate elements of American stud poker, blackjack or "21", and an ancient Chinese game of poker. From their initially distribution of cards, each player and the house or dealer form three different hands (one hand is poker-like and the other two hands are blackjack-like). Up to four bets are linked to the outcome of each player's cards as compared with the result of the house's cards.

2. Description of the Background Art

The games of poker and blackjack or similar equivalents have existed for centuries. Specifically, U.S. Pat. No. 4,836,553 discloses a poker game in which five cards are dealt to each player and the dealer. Should the dealer not have an ace and a king or better each player wins, but if the dealer has an ace and a king or better then standard poker hands establish the winner between each player and the dealer. Betting is coupled into each possible winning scenario.

U.S. Pat. No. 4,861,041 describes methods of progressive jackpot gaming in which either a live gaming table or a token accepting electro-mechanical apparatus is utilized. A cumulative jackpot is included and betters win either all or a portion of this jackpot by having a hand containing a predetermined arrangement of cards.

Malek has developed casino games presented in related U.S. Pat. Nos. 5,265,882; 5,328,189; and 5,395,120. The '882 game is a combination of blackjack, draw poker, and baccarat in which each player play at least two of the three games against the dealer and other players. In the '189 game blackjack and baccarat are combined and each player can play both games against the dealer and other player. For the '120 game, the games of modified draw poker and blackjack are mixed into a situation in which each player bets and plays against other players and the house dealer.

A method of playing a multiple hand card game is presented in U.S. Pat. No. 5,322,295. The game involves multiple bettings. As each bet or wager is made a portion of the hand is dealt.

U.S. Pat. No. 5,417,430 relates a progressive wagering method and game. A game wager and optional jackpot bet are made before the cards are dealt. The dealer then deals two cards to him/herself and three to each player, all face down. Wagers and jackpot bets are then decided in a stepwise manner.

A method and apparatus for playing a poker-like game are presented in U.S. Pat. No. 5,486,005. After wagers are made, an array of seven hands, each with four cards face-up, are dealt by the dealer. A variety of final betting combinations am then selected by the players and three more cards are dealt face-up. The dealer then determines the winners and losers. Option jackpot means are provided.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to furnish a method of playing a card game that presents several chances for each player to win from the cards received from the house.

Another object of the present invention is to provide a card game between a house and at least one player in which poker and blackjack hands exits for each player in combination with mandatory and optional wagering.

A further object of the present invention is to describe a card game between a house and at least one player in which each player has one poker hand, a low blackjack hand, and a high blackjack hand in which a mandatory bet is associated with each of the three hands and an optional progressive jackpot bet is linked to the outcome of the poker hand.

Still another object of the present invention is to supply a card game between a house and at least one player in which the assignment of hands is based on a comparison between a randomly generated number and assigned numbers for each player location.

Yet a further object of the present invention is to produce a gaming apparatus utilized in playing a card game between a house and at least one player in which poker and blackjack hands exits for each player in combination with mandatory and optional wagering.

Disclosed is a method of playing a card game between a house and one to six players. Every player in the game selects at least one of six player positions at a card table. The players then wager at least one bet and usually a mandatory poker bet, a mandatory high blackjack bet, a mandatory low blackjack bet, and an optional poker fourth bet. The house, a dealer or automated machine, randomizes cards within a deck of 52 cards and distributes the randomized cards in a face down manner into seven five card hands, one hand for the house and one hand for each player.

Usually, the roll of three dice, or other means, produces a random number that is utilized to determine which of the hands is placed at a house position on the table and which of the hands is placed at each of the player positions on the table. Generally, the numbers 1, 8, and 15 are assigned to the house position and numbers 2–7, 9–14, and 16–18 to the player positions in a clockwise manner from the house position. Using the established random number, the assigned number is matched to the established random number to produce a first hand position. From this position on the house places a first of the five card hands at the first hand position and continues placing the hands in a clockwise distribution process until all seven of the hands am located at the house position and the player positions. Extra randomized cards not found within any of the hands and any of the hands at the player positions not matched with a player am placed into a discard area.

Each player arranges two or three of their the five card hand into a high blackjack hand and places the high blackjack hand face down into a high hand designated area at their position on the card table. The remainder of their the five card hand is arranged into a low blackjack hand and placed face down into a low hand designated area at their position on the card table.

The house turns its five card had face up and sets its five card hand into a two or three card high blackjack hand and places the high blackjack hand face up into a high hand designated area at the house position on the card table. The remainder of the house's five card hand is arranged into a low blackjack hand and placed face up into a low hand designated area at the house position on the card table.

A poker hand for the house is created out of its the randomized cards and a poker hand is created for each player hand out of their randomized cards.

Each players hand is compared with the house's hand to establish a winning poker hand, a winning high blackjack hand, and a winning low blackjack hand. Winnings are allocated from each of the mandatory bets based on the comparison. Further, a determination, based on a schedule listing eligible winning poker hands, is made of winnings for each of the players who bet the optional fourth bet. Usually, the optional fourth bet is a progressive jackpot bet that is paid based on a table of applicable percentages and is paid even if the house's poker hand is higher.

A game apparatus utilized in playing a card game between a house and one to six players comprises: a playing surface; a house position inscribed on the playing surface; a plurality of player positions designated on the playing surface for presenting player hands; a plurality of first betting regions marked on the playing surface for placing mandatory first bets; a plurality of second betting regions marked on the playing surface for placing mandatory second bets; a plurality of third betting regions marked on the playing surface for placing mandatory third bets; and a plurality of fourth betting regions marked on the playing surface for placing optional fourth bets.

Usually, each of the plurality of player positions comprises a first domain for placing cards selected to be within a low blackjack hand and a second domain for placing cards selected to be within a high blackjack hand. Also, usually each of the plurality of first betting regions is proximate the first domain for placing cards selected to be within a low blackjack hand and each of the plurality of second betting regions is proximate the second domain for placing cards selected to be within a high blackjack hand.

Other objects, advantages, and novel features of the present invention will become apparent from the detailed description that follows, when considered in conjunction with the associated drawings.

DESCRIPTION OF THE PREFERRED EMBODIMENT

Figure 1:
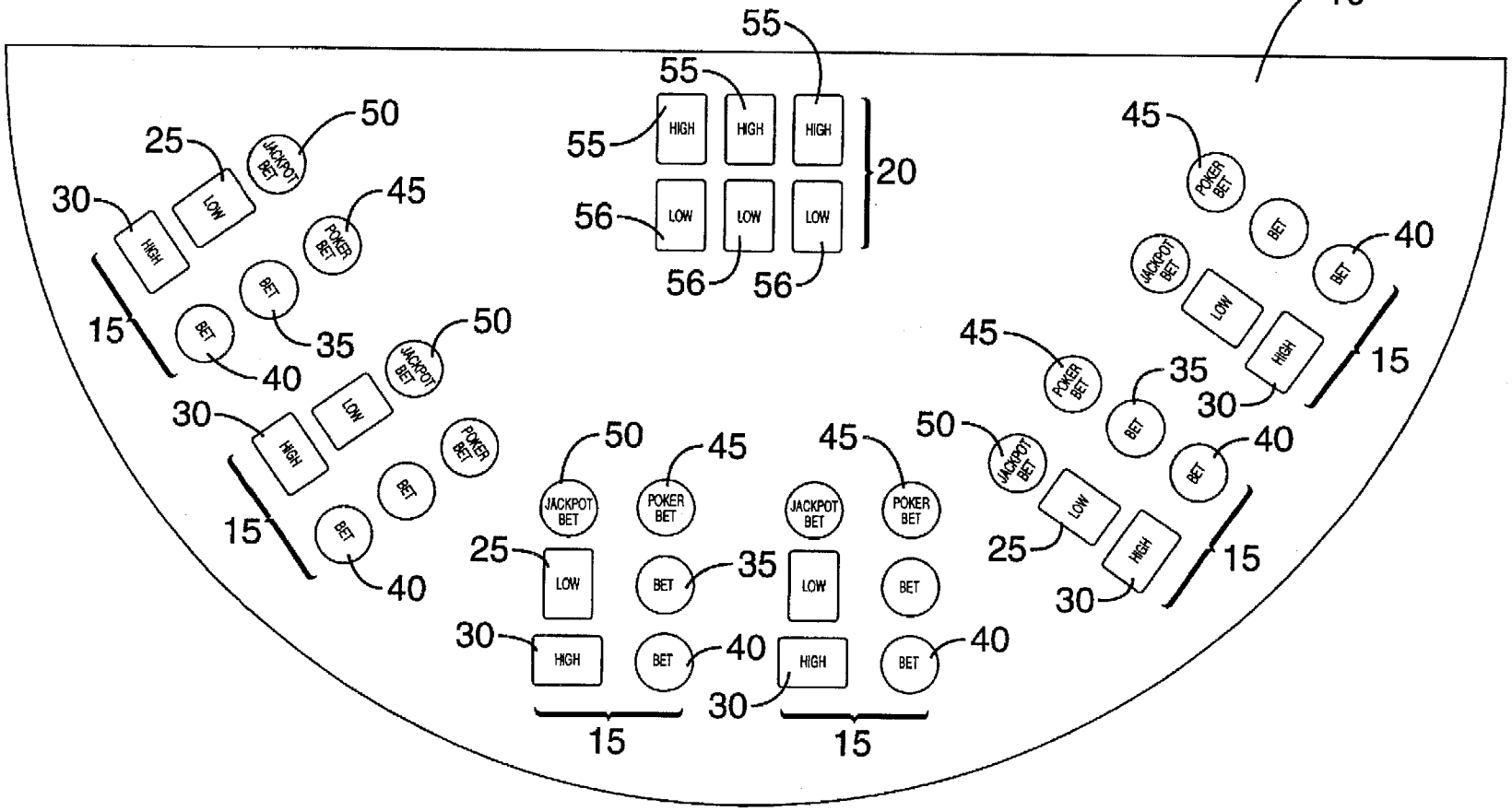
FIG. 1 is an overhead view of a gaming table showing the layout of hand and betting positions for the subject invention.

Referring now to FIG. 1, there is shown a preferred embodiment of a gaming table layout of the subject invention. Comprising the subject invention is an apparatus and method of playing a card game between a house or dealer (for purposes of this specification and appended claims, the term house or dealer are equivalent and used interchangeably) and one or more players. The game is usually played between a house and one to six players. Generally, the subject game comprises the steps of: each player wagering at least one bet and preferably three; the house randomizing cards within a deck of cards; the house distributing the randomized cards into a predetermined number of hands; establishing by hand selection means which of the predetermined number of hands goes to the house and each player in the card game; each player arranging their randomized cards into a high blackjack hand and a low blackjack hand; the house setting its randomized cards into a high blackjack hand and a low blackjack hand; creating a poker hand for the house out of its randomized cards and a poker hand for each player out of their randomized cards; comparing each player's hand with the house's hand to establish a winning poker hand, a winning high blackjack hand, and a winning low blackjack hand; and allocating winnings from each bet based on the comparison.

More specifically, the subject card game employs the gaming or card table or covering shown in FIG. 1. A playing surface 10 is fabricated from suitable materials including natural and synthetic materials or coating such as felt, felt-like cloths, cardboard, plastics, and the like. The playing surface 10 is usually patterned to conform to the shape of casino tables and the like or may be produced is any desired geometric configuration such as semi-circular, circular, rectangular, and the like or with any suitable regular or irregular boundaries. The playing surface 10 may be placed on a game board for use at locations other than in a typical gambling casino. Symbols, writing, and the like are marked on the playing surface 10 by standard means such as printing, painting, drawing, and similar techniques.

Player positions 15 are denoted on the playing surface 10. The number of player positions 15 may vary between one and six, however, preferably, the number of player positions 15 is six, as shown in FIG. 1. A house position 20 is marked in a suitable manner on the playing surface 10, usually opposite to or across from the location of the player positions 15.

Usually, each player position 15 comprises a low blackjack designated area 25 and a high blackjack designated area 30. Additionally, three, usually mandatory betting regions are provided. Specifically, a first betting region 35 is marked proximate the low blackjack designated area 25, a second betting region 40 is marked proximate the high blackjack designated area 30, and a third betting region 45 is marked on the playing surface 10 in any suitable location, usually somewhere between the blackjack areas 25 and 30 and the house position 20, although other locations are possible. Also, a fourth betting region 50, usually for an optional bet, is marked on the playing surface 10. As with the third betting region 45, the fourth betting region 50 is marked on the playing surface 10 in any suitable location, usually somewhere between the blackjack areas 25 and 30 and the house position 20, although other location are possible.

Generally, the house position 20 occupied by the dealer comprises six designated spaces aligned in outer 55 and inner 56 three card spaces, but other notations may be utilized to denote house cards with low and high blackjack hands. For example, two cards in a high blackjack hand may be placed in two of the aligned three outer or bottom spaces 55 and the other three cards in a low blackjack hand may be placed in three of the other aligned inner or top spaces 56. The basic notion for the house position, like with the player positions is to present a display area for exhibiting the low and high blackjack hands.

The method by which the subject game is played is now described in terms of a preferred set of elements, however, those skilled in the art will appreciate that equivalent substitutions are also within the realm of the subject invention. Six player positions are used as a preferred illustrative example and not by way of limitation, as are the exemplary minimum opening hands, winning hands, hands that are considered to be ties, and the like.

Object of the Game

The object of the card game of the subject invention is for any one of the player's three hands to be higher than any one of the or dealer's three hands. Preferably, each player's five card stud poker hand (other types of suitable poker are considered equivalent) needs to contain a pair of deuces, (any pair through tens), or higher to qualify for play against the dealer's five card stud poker hand. Equal value hands between dealer and player in the poker hand is considered a loss for the player.

The player now splits the five cards into two blackjack hands. A low blackjack hand, of the player's choice and containing two or three cards, can be played to the value of 21. If the player's hand is greater than 21 the player "busts," thereby resulting in the loss of the wagered bet. A high blackjack hand, containing two or three cards depending on if three or two cards, respectively, are in the low hand, of the player's choice may be played to the value of 21. Each hand is played separately against the dealer's equivalent hand. For the blackjack hands, each hand consisting of the same value between the player and the dealer is considered a "push" or tie with no winner.

Play of the Game

The house, specifically the dealer, shuffles the cards and deals seven hands in a left to right array in front of or over the dealer's position 20 on the playing surface 10. Each hand contains five cards that are dealt face down. Usually, the dealer checks to verify that all 52 cards are accounted for, then places the balance of the cards in a discard holder.

Generally, a dice cup containing three dice is shaken by the dealer or selected player to determine who receives the first hand. The first hand is defined as the hand dealt to the dealer's far left within the array of hands. The numbers 1, 8, and 15 are assigned to the house position 20 and the numbers 2–7, 9–14, and 16–18 are assigned to the player positions 15 in a clockwise manner from the house position 20. Using the random number generated by rolling the three dice or other means, the random number is matched to the assigned number to produce a first hand position. The dealer places the far left hand at the first hand position and continues distributing the hands until all seven hands are located at the player positions 15 and the house position 20. Hands that are not matched to an actual player are placed in the discard area or holder.

Each player then arranges the cards in their hand into a two or three card high blackjack hand and places it in the high blackjack hand designated area 30, with the hand being better if it is closer to 21 in the standard manner. The remainder of the cards are placed in the low blackjack hand designated area 25.

The dealer does not look at their cards until all of the player's have set their hands in the designated areas 25 and 30 face down. Once all of the player cards have been placed face down in the selected areas 25 and 30, the dealer turns the dealer's cards face up and creates the dealer's low and high blackjack hands. For consistency, house rules are applied to establish how the dealer forms the low and high hands. The house rules follow general blackjack procedures but are flexible and varied by individual house requirements. The dealer then places the created hands in the dealer's position 20, low hand on top and high hand on bottom.

To determine winning hands, each of the player's hands is then compared with the dealers equivalent hand. Player wagers that are lost are removed from the betting regions. A player wager that is a "push" is left on the in its betting region. Cards that are within a losing player hand, by virtue of being of lesser value than the dealers equivalent hand or by going "busted" by exceeding 21, are removed and placed in the discard area or holder.

Generally, winning poker hands are paid according to a bonus payout schedule (see below). Although the payout may vary, usually, winning high and low blackjack hands pay even money. Winning progressive jackpot hands are paid after all other payoffs are made according to a progressive jackpot schedule (see below).

Game Bets

Preferably, there are four different bets in the subject game and are placed before the card are dealt. Usually and preferably, one of these bets is optional, but the other three are mandatory. The three mandatory bets are: a five card stud poker wager (placed in area 45 on the playing surface 10) that pays according to a predetermined payout schedule (see below); a low blackjack hand wager (placed in area 35 on the playing surface 10) that pays according to standard blackjack odds (in most cases even odds); and a high blackjack hand wager (placed in area 40 on the playing surface 10) that is preferably exactly twice the amount of the low blackjack hand wager and pays according to standard blackjack odds (in most cases even odds). The optional fourth bet is a jackpot wager (placed in area 50 on the playing surface 10) that entitles the player to a progressive jackpot payoff according to a predetermined schedule (see the Table 2 Progressive Jackpot Payoff Schedule below).

Bonus Payout Schedule

The player may be eligible for a bonus payout if the player's hand is higher than the dealer's hand with any of the following hands. The qualifying hands and cited odds are only by way of reference and not intended to be limiting and may vary according to the wishes or standards of the house.

TABLE 1

Bonus Odds

| Hand | Odds* |
|---|---|
| One Pair | Even |
| Two Pairs | 2 to 1 |
| Three of a Kind | 3 to 1 |
| Straight | 4 to 1 |
| Flush | 5 to 1 |
| Full House | 7 to 1 |
| Four of a Kind | 20 to 1 |
| Straight Flush | 50 to 1 |
| Royal Flush | 100 to 1 |

*Up to the table's maximum payout.

Progressive Jackpot Wager

The player has the option to place a fourth bet or wager in the jackpot area 50 on the betting surface 10. If the player chooses to play this wager, it must be placed at the same time all other wagers are placed. Players may qualify for the progressive jackpot payoff by drawing one on the five poker hands listed in Table 2. This jackpot bet is paid even if the dealer's hand is higher. In the event two of more players qualify for the progressive jackpot in the same hand, the player's share in the jackpot in a pro-rated system. The exact jackpot payoff values shown in Table 2 may vary and be set by the house's standards to low or higher quantities.

TABLE 2

| Progressive Jackpot Payoff Schedule | |
|---|---|
| Hand | Payoff |
| Royal Flush | $1000.00 or 100%* |
| Straight Flush | $250.00 or 10%* |
| Four of a Kind | $100.00 |
| Full House | $75.00 |
| Flush | $50.00 |

*Percentage paid of progressive jackpot, where applicable.

Additional Preferred Specific Rules of the Game

Various specific rules can be created by the house to facilitate operation of the subject game under diversified conditions or requirements. Listed below are eight rules that are usually and preferably applied to the subject game.

1. Players are not allowed to show their hands or talk to other player's about their hands before all of the cards are exposed.

2. Any player who sets their hand incorrectly (e.g., the two or three card low blackjack hand ranks higher than the two or three card high blackjack hand or the player places more than three cards in either blackjack hand) is an automatic losing hand. Players am responsible for arranging their own hands.

3. Before the dice am uncovered all wagers must be placed in betting regions. No wagers are allowed after the dice are exposed.

4. For the stud poker hand, players must have a pair or better to qualify. All non-qualifying hands are considered a losing hand. Each player hand must be of higher value than the dealer's hand and all equal value hands will be considered a losing hand.

5. All five cards must be played in forming the low and high blackjack hands with a minimum of two cards and a maximum of three cards in both the low and high blackjack hands.

6. Any high blackjack hand or low blackjack hand over 21 is considered a "busted" hand and automatically is a losing hand.

7. A two card blackjack (a combined card count total of 21 with only two cards) is a higher value hand than a three card 21 hand.

8. Numbered cards have their associated number value, face cards count ten, and aces are counted as one or eleven.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A method of playing a card game between a house and one or more players, comprising the steps of:

a) each player wagering at least one bet;

b) the house randomizing cards within a deck of cards, and establishing a numerical value for each card in said deck of cards;

c) the house distributing said randomized cards into a predetermined number of hands;

d) establishing by hand selection means which of said predetermined number of hands goes to the house and each player in the card game;

e) each player arranging their said randomized cards into a high blackjack hand and a low blackjack hand wherein each player's high balckjack hand comprises cards having a numerical sum that is closer to twenty-one, without exceeding twenty-one, than said player's low blackjack hand;

f) the house setting its said randomized cards into a high blackjack hand and a low blackjack hand wherein the house's high blackjack hand comprises cards having a numerical sum that is closer to twenty-one, without exceeding twenty-one, than the house's low blackjack hand;

g) creating a poker hand for the house by combining said randomized cards of the house's high blackjack hand and the house's low blackjack hand, and creating a poker hand for each said player by combining said randomized cards of said player's high blackjack hand and said player's low blackjack hand;

h) comparing each player's poker hand, high blackjack hand and low blackjack hand with the house's poker hand, high blackjack hand and low blackjack hand, respectively, using conventional poker hand rankings and conventional blackjack rules to establish a winning poker hand, a winning high blackjack hand, and a winning low blackjack hand; and i) allocating winnings from each said bet based on said comparison.

2. A method of playing a card game according to claim 1, wherein said predetermined number of hands comprises seven, including a hand for the house.

3. A method of playing a card game according to claim 1, wherein each said predetermined number of hands comprises five randomized cards.

4. A method of playing a card game according to claim 1, wherein said hand selection means comprises a random number generating means and specific numbers associated with each of said players and the house.

5. A method of playing a card game according to claim 4, wherein said random generating means comprises rolling three dice and obtaining a total number.

6. A method of playing a card game between a house and one or more players, comprising the steps of:

a) each player wagering three mandatory bets and optionally a fourth bet;

b) the house randomizing cards within a deck of cards, and establishing a numerical value for each card in said deck of cards;

c) the house distributing said randomized cards in a face down manner into a predetermined number of hands with five cards in each of said hands;

d) establishing by a roll of three dice a random number and utilizing said random number to determine which of said predetermined number of hands goes to the house and each player in the card game;

e) each player arranging two or three of their said randomized cards into a high blackjack hand and the remainder of their said randomized cards into a low blackjack hand wherein each player's high blackjack hand comprises cards having a numerical sum that is closer to twenty-one, without exceeding twenty-one, than said player's low blackjack hand;

f) the house setting its said randomized cards into a two or three card high blackjack hand and the remainder of its said randomized cards into a low blackjack hand wherein the house's high blackjack hand comprises card having a numerical sum that is closer to twenty-one, without exceeding twenty-one, than the house's low blackjack hand;

g) creating a poker hand for the house by combining said randomized cards of the house's high blackjack hand and the house's low blackjack hand, and creating a poker hand for each said player by combining said randomized cards of said player's high blackjack hand and said player's low blackjack hand;

h) comparing each player's poker hand, high blackjack hand and low blackjack hand with the house's poker hand, high blackjack hand and low blackjack hand, respectively, using conventional poker hand rankings and conventional blackjack rules to establish a winning poker hand, a winning high blackjack hand, and a winning low blackjack hand;

i) allocating winnings from each of said mandatory bets based on said comparison; and j) determining for each said player who bet said optional fourth bet, if said player wins said fourth bet based on a fourth bet schedule listing eligible winning poker hands.

7. A method of playing a card game according to claim 6, wherein said predetermined number of hands comprises seven.

8. A method of playing a card game according to claim 7, further comprising the step of placing extra said randomized cards not found within any of said hands and any said hands not matched with a player into a discard area.

9. A method of playing a card game between a house and one to six players, comprising the steps of:

a) each player selecting at least one of six player positions at a card table;

b) each player wagering for each said selected player position a mandatory poker bet, a mandatory high blackjack bet, a mandatory low blackjack bet, and an optional poker fourth bet;

c) the house randomizing cards within a deck of 52 cards, and establishing a numerical value for each card in said deck of cards;

d) the house distributing said randomized cards in a face down manner into seven five card hands, one of said hands for the house and one of said hands for each of said player positions;

e) establishing by a roll of three dice a random number and utilizing said random number to determine which of said hands is placed at a house position and which of said hands is placed at each of said player positions;

f) placing extra said randomized cards not found within any of said hands and any said hands at said player positions not matched with a player into a discard area;

g) each player arranging two or three of their said five card hand into a high blackjack hand and placing said high blackjack hand face down into a high hand designated area at their said player position on said card table and the remainder of their said five card hand into a low blackjack hand and placing said low blackjack hand face down into a low hand designated area at their said player position on said card table, wherein each player's high blackjack hand comprises cards having a numerical sum that is closer to twenty-one, without exceeding twenty-one, than said player's low blackjack hand;

h) the house turning its said five card hand face up and setting its said five card hand into a two or three card high blackjack hand and placing said high blackjack hand face up into a high hand designated area at said house position on said card table and the remainder of its said five card hand into a low blackjack hand and placing said low blackjack hand face up into a low hand designated area at said house position on said card table, wherein the house's high blackjack hand comprises cards having a numerical sum that is closer to twenty-one, without exceeding twenty-one, than the house's low blackjack hand;

i) creating a poker hand for the house by combining said randomized cards of the house's high blackjack hand and the house's low blackjack hand, and creating a poker hand for each said player by combining said randomized cards of said player's high blackjack hand and said player's low blackjack hand;

j) comparing each player's poker hand, high blackjack hand and low blackjack hand with the house's poker hand, high blackjack hand and low blackjack hand, respectively, using conventional poker hand rankings and conventional blackjack rules to establish a winning poker hand, a winning high blackjack hand, and a winning low blackjack hand;

k) allocating winnings from each of said mandatory bets based on said comparison; and l) determining for each said player who bet said optional fourth bet, if said player wins said optional fourth bet based on a schedule listing eligible winning poker hands.

10. A method of playing a card game according to claim 9, wherein said random number hand placement step further comprises the steps of:

a) assigning numbers 1, 8, and 15 to said house position and numbers 2–7, 9–14, and 16–18 to said player positions in a clockwise manner from said house position;

b) using said established random number and matching to said assigned number to produce a first hand position; and c) placing a first of said five card hands at said first hand position and continuing placing said hands in a clockwise distribution process until all seven said hands are located at said house position and said player positions.

11. A method of playing a card game according to claim 9, wherein said optional fourth bet is a progressive jackpot bet that is paid based on a table of applicable percentages.

12. A method of playing a card game according to claim 9, wherein said optional fourth bet is paid even if the house's poker hand is higher.

* * * * *